US006272702B1

(12) United States Patent
Uchida et al.

(10) Patent No.: US 6,272,702 B1
(45) Date of Patent: Aug. 14, 2001

(54) MULTIFUNCTION BED

(75) Inventors: Hiroshi Uchida, Oumihachiman; Satoku Oishi, Kyoto, both of (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/428,544

(22) Filed: Oct. 29, 1999

(30) Foreign Application Priority Data

Oct. 30, 1998 (JP) ..... 10-310140
Nov. 2, 1998 (JP) ..... 10-312089

(51) Int. Cl.[7] ..... A61G 7/16
(52) U.S. Cl. ..... 5/600; 5/612; 5/618; 5/81.1; 5/86.1
(58) Field of Search ..... 5/600, 612, 616, 5/618, 624, 81.1, 86.1; 297/DIG. 4

(56) References Cited

U.S. PATENT DOCUMENTS 2,564,083 * 8/1951 Stechert ..... 5/618
2,607,929 * 8/1952 Balluff .
3,010,121 * 11/1961 Breach ..... 5/618
3,112,001 * 11/1963 Wise ..... 5/618 X
3,138,805 * 6/1964 Piazza ..... 5/618
3,936,893 * 2/1976 Anderson et al. ..... 5/86.1
4,285,541 * 8/1981 Onishi ..... 5/81.1 R
4,987,620 * 1/1991 Sharon ..... 5/86.1 X
5,555,582 * 9/1996 Jerideau ..... 5/86.1

FOREIGN PATENT DOCUMENTS 7-93938 10/1995 (JP) .

* cited by examiner

*Primary Examiner*—Michael F. Trettel
(74) *Attorney, Agent, or Firm*—Armstrong, Westerman, Hattori, McLeland & Naughton, LLP

(57) ABSTRACT

The present invention provides a multifunction bed that has a simple structure to allow its size to be reduced and that can be automatically changed between a bed form and a wheelchair form using very simple operations. This multifunction bed comprises a fixed U-shaped bed 1 having a U-shaped cut-out section 6 and a movable auxiliary bed 2 that is detachably fitted in the U-shaped cut-out section of the fixed U-shaped bed. The movable auxiliary bed can travel on underlying wheels 14 and 16 and can be changed between a bed form for a horizontal position and a wheelchair form having a backrest section 19, a seat section 20, and a leg-rest section 21. In order to prevent a person lying on the bed from being pushed forward while the movable auxiliary bed is being changed to the wheelchair form, the seat section is inclined according to the inclination of the backrest section so that part of the seat section closer to the leg rest section is located higher than the remaining part, thereby allowing the buttocks of the person lying on the bed to sink relative to the bed form.

19 Claims, 14 Drawing Sheets

MULTIFUNCTION BED

FIELD OF THE INVENTION

The present invention relates to a multifunction bed used for nursing, and in particular, to a multifunction bed the form of which can be automatically switched between a bed and a wheelchair, and wherein this form change enables a person lying on the bed to change from a horizontal position to a sitting position appropriate for wheelchair movement.

BACKGROUND OF THE INVENTION

Various nursing beds have been developed and provided that are used in hospitals for patients who require nursing. Such nursing beds allow patients to lie thereon in a horizontal state, and some are configured so as to be bent into the form of a reclining seat.

In a conventional nursing bed, a separate wheelchair must be made available for moving a patient to another location, and further, a lifting device must be made available for helping the patient into the wheelchair.

At the same time, numerous efforts are underway to research and develop multifunction nursing beds offering the functions of both a bed and a wheelchair. Such multifunction nursing beds have a complex structure and constitute large and expensive devices.

Furthermore, the multifunction nursing beds developed through conventional research activity require a complex control means to change the horizontal bed form into a wheelchair form, or vice versa. Such a control means is cumbersome to operate.

Furthermore, these conventional multifunction nursing beds are prone to numerous problems with operational safety during the changing process between a horizontal bed form and a wheelchair form.

The present invention thus attempts to solve the above-noted problems of conventional multifunction nursing beds, and is intended to provide a safe, reliable multifunction bed having a simple structure that is more compact and affordable than existing versions, and that can be automatically changed between a bed form and a wheelchair form using very simple operations.

SUMMARY OF THE INVENTION

In order to achieve this object, the present invention specifically configures a multifunction bed comprising a fixed U-shaped bed having a U-shaped cut-out section and a movable auxiliary bed that is detachably fitted in the U-shaped cut-out section of the fixed U-shaped bed.

Furthermore, according to the present invention, the movable auxiliary bed can travel on underlying wheels and is configured so as to be changed between a bed form in its horizontal position and a wheelchair form having a backrest section, a seat section, and a leg-rest section.

In addition, according to the present invention, when a person lying on the bed simply touches a switch, the bed can be changed from its horizontal bed form to its wheelchair form, and during this change, the person lying on the bed is gradually moved to a sitting position.

Furthermore, the present invention provides a multifunction bed wherein, in order to prevent the person lying on the bed from being pushed forward while the movable auxiliary bed is being changed to its wheelchair form, the seat section is inclined according to the inclination of the backrest section, such that part of the seat section closer to the leg-rest section is located higher than the opposed part, thereby allowing the buttocks of the person lying on the bed to sink relative to the horizontal bed form.

In addition, according to the present invention, the movable auxiliary bed can be changed to its wheelchair form within the fixed U-shaped bed using a power transmission section placed on the fixed U-shaped bed.

Furthermore, according to the present invention, a self-lock means is used to change to the wheelchair form, and after the bed form has been changed to the wheelchair form and when a drive source is stopped, the self-lock means automatically maintains that form in a stable condition.

Furthermore, according to the present invention, the drive source is a rotation drive motor, and the self-lock means comprises a worm gear mechanism comprising a worm and a worm wheel.

Furthermore, according to the present invention, the drive source is a rotation drive motor, and the self-lock means comprises a power transmission mechanism including a one-way clutch.

Furthermore, according to the present invention, the drive source is a rotation drive motor, and the self-lock means comprises a power transmission mechanism including a ratchet wheel mechanism.

Furthermore, according to the present invention, the drive source is a rotation drive motor, and the self-lock means comprises a screw-type power transmission mechanism.

Furthermore, according to the present invention, the drive source is a hydraulic drive system, and the self-lock means includes a check valve mechanism for the hydraulic drive system.

Furthermore, the present invention provides a multifunction bed comprising a link mechanism for individually interlocking and connecting the backrest, seat, and leg-rest sections to a body frame so that using the link mechanism, a single drive source can deform a horizontal bed section of the movable auxiliary bed into the backrest, seat, and leg-rest sections of the wheelchair.

Furthermore, according to the present invention, when the movable auxiliary bed is fitted in the fixed U-shaped bed in order to return to its original horizontal position, the user sitting in the wheelchair automatically returns to a lying position.

Furthermore, according to the present invention, when the movable auxiliary bed in the wheelchair form is simply pressed into the U-shaped cut-out section of the fixed U-shaped bed, it is automatically joined and fixed to a power transmission section placed on the fixed U-shaped bed.

Furthermore, according to the present invention, in the bed form for the horizontal position, auxiliary wheels automatically extend via the link mechanism to stabilize the bed's position, thereby preventing the user from being rotated even when the user's weight rests on his/her tiptoes.

Furthermore, according to the present invention, in the bed form, an armrest is housed in the rear of the backrest section, whereas in the wheelchair form, the armrest extends forward.

Furthermore, according to the present invention, an inlet guard of the fixed U-shaped bed can be opened, closed, and locked.

BRIEF DESCRIPTION OF THE DRAWINGS

FIG. 1A is a schematic perspective view showing a multifunction bed comprising a combination of a fixed U-shaped bed and a movable auxiliary bed, wherein the bed is in its horizontal bed form. FIG. 1B is a schematic perspective view showing that within the fixed U-shaped bed, the movable auxiliary bed has been changed to its wheelchair form via a reclining seat form. In this view, the fixed U-shaped bed is partly exploded. FIG. 1C is a schematic perspective view showing that the movable auxiliary bed has been changed to its wheelchair form and disconnected from the fixed U-shaped bed.

FIG. 6A is a connection circuit diagram of a control system showing operation switches installed in the multifunction bed, a connecting confirmation switch for confirming the connection between the fixed U-shaped bed and the movable auxiliary bed, a lowest-position limit switch that operates upon detection of the position of the horizontal bed form, and a highest-position limit switch that operates upon detection of the position of the wheelchair form. FIG. 6B is a connection circuit diagram including a rotation drive source (a motor M).

FIGS. 9A–9C are schematic side views showing how the movable auxiliary bed is maintained in its horizontal bed form, reclining seat form, and wheelchair forms, respectively.

DETAILED DESCRIPTION OF THE PREFERRED EMBODIMENTS

Figure 1A:
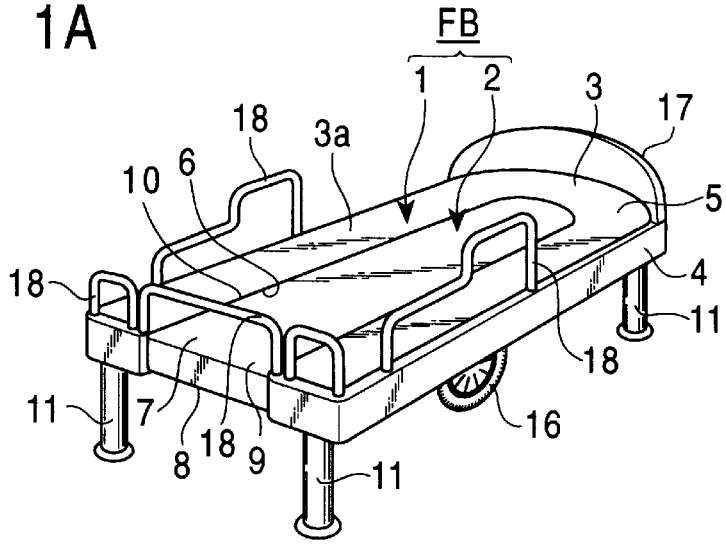
FIGS. 1A, 1B and 1C schematically illustrate one specific embodiment of a multifunction bed according to the present invention.

A multifunction bed according to the present invention is described based on the specific examples shown in the drawings.

First, referencing FIGS. 1 to 6, the basic structure of a multifunction bed FB according to the present invention is described in detail. As shown in FIGS. 1A, 1B and 1C, the multifunction bed FB is composed of a combination of a fixed U-shaped bed 1 and a movable auxiliary bed 2.

The fixed U-shaped bed 1 has a bed surface constituent 3. The bed surface constituent 3 is composed of a bed frame 4 and a mat 5 mounted on the bed frame 4 and has a U-shaped cut-out section 6 therein. Meanwhile, the movable auxiliary bed 2 has a bed surface constituent 7. The bed surface constituent 7 is composed of a bed frame 8 and a mat 9 mounted on the bed frame 8. A profile 10 of the bed surface constituent 7 is shaped to fit in the U-shaped cut-out section 6 of the fixed U-shaped bed 1.

At the same time, a plurality of legs 11 used to adjust the height of the fixed U-shaped bed 1 in installing the bed 1 in a desired installation site and a body section 12 on which a drive source, which will be described below, is mounted are combined on the bottom surface of the bed frame 4, part of the bed surface constituent 3 of the fixed U-shaped bed 1. A body frame 13 for a wheelchair, which will be described below, is mounted on the bed frame 8 of the bed surface constituent 5 of the movable auxiliary bed 2. A pair of castor-type front wheels used to change the direction of movement and a pair of rear wheels 16 including an axle shaft 15 are attached to the body frame 13. Thus, the movable auxiliary bed 2 is configured to travel freely as a wheelchair.

The fixed U-shaped bed 1 comprising the legs 11 and the movable auxiliary bed 2 comprising the pair of front wheels 14 and the pair of rear wheels 16 via the body frame 13 are designed so that the top surface of the mat 5 of the bed surface constituent 3 of the fixed U-shaped bed 1 is flush with the top surface of the mat 9 of the bed surface constituent 7 of the movable auxiliary bed 2 when the beds are combined into a horizontal bed form as shown in FIG. 1A.

A guard member 17 and a fence member 18 functioning as a handrail are attached to the periphery of the top surface 3*a* of the bed surface constituent 3 of the fixed U-shaped bed 1.

According to the present invention, the movable auxiliary bed 2 comprises a part of a horizontal bed in its horizontal bed form and can be changed to a reclining seat in its reclining seat form or a wheelchair in its wheelchair form. Thus, the movable auxiliary bed 2 is designed to function as a bed, reclining seat, and wheelchair.

As shown below, the movable auxiliary bed 2 is designed so as to function in all three forms above. First, the bed surface constituent 7 of the movable auxiliary bed 2 is divided into a backrest section 19, a seat section 20, and a leg-rest section 21, that constitute the wheelchair, and are connected by joint-like connection means 22 and 23 so as to bend freely.

According to the illustrated embodiment, the leg-rest section 21 of the movable auxiliary bed 2 is divided into a hanging section 21A and a footrest section 21B connected to the hanging section 21A via a joint-like connection means 24.

According to the present invention, the movable auxiliary bed 2 comprises the body frame 13 and a link mechanism 25, and the bed surface constituent 7, comprising the backrest section 19, the seat section 20, and the leg-rest section 21, is individually interlocked and connected to the body frame 13 via the link mechanism 25.

The body frame 13 of the movable auxiliary bed 2 comprises a front wheel support frame section 26 supporting the pair of front wheels 14, an intermediate frame section 27 fixed to the front wheel frame section 26, and a rear wheel support section 28 supporting the axle shaft 15 of the pair of rear wheels 16.

While the bed surface constituent 7 of the movable auxiliary bed 2 is in the horizontal bed form, the upper end 26*a* of the front wheel support frame section 26 of the body frame 13 of the movable auxiliary bed 2 abuts on the bottom surface of the bed frame 8 of the bed surface constituent 7 to stably support the horizontal bed form of the bed surface constituent 7.

The lower end 26*b* of the front wheel support frame section 26 of the body frame 13 has a footrest-section locking frame section 29 for restraining the movement of the footrest section 21B of the leg-rest section 21 of the bed surface constituent 7 of the movable auxiliary bed 2, in order to bend the footrest section 21B around the joint-like connection means 24.

Furthermore, the body frame 13 has fixedly attached thereto a first bracket member 30 and a second bracket member 31 for connecting the body frame 13 to the bed surface constituent 7 via the link mechanism 25.

At the same time, according to the present invention, by pressing and fitting the movable auxiliary bed 2 in the U-shaped cut-out section 6 of the fixed U-shaped bed 1, a power transmission section 33A, placed on the fixed U-shaped bed 1, and a power transmission receiving section 33B, placed on the movable auxiliary bed 2, allow the movable auxiliary bed 2 to be automatically connected to a rotation drive motor 34 mounted on the fixed U-shaped bed 1 and acting as a drive source, so as to be driven by the motor 34.

Figure 5:
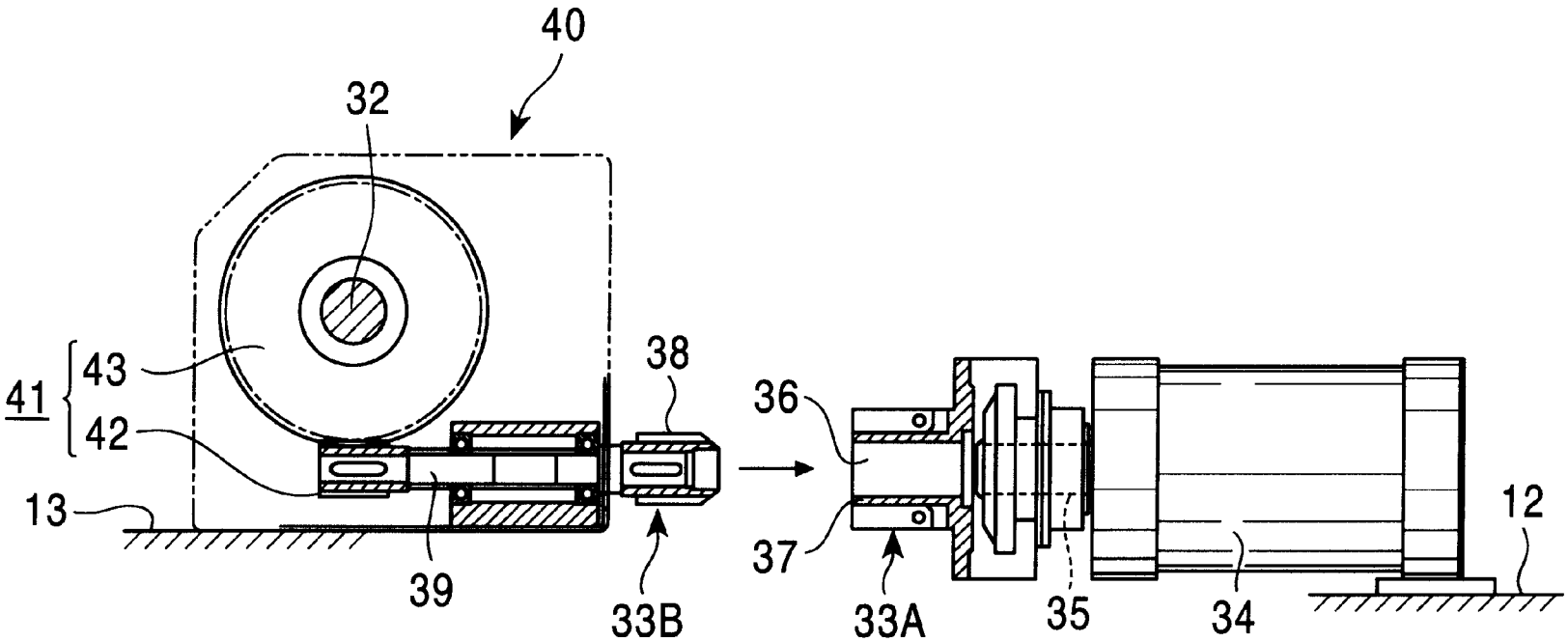
FIG. 5 is a schematic side view showing a specific embodiment of the multifunction bed according to the present invention and showing an example of a preferred configuration of a power source and a power transmission section, wherein a power transmission section mounted on the movable auxiliary bed and including a self-lock means has been disconnected from a power transmission section mounted on the fixed U-shaped bed and including a rotational movement drive source.

According to the specific embodiment shown in FIG. 5, the power transmission section 33A attached to a rotating shaft 35 of the rotation drive motor 34 mounted on the fixed U-shaped bed 1 is structured to include a key groove 37 provided in a socket 36 opened toward its tip. The power transmission receiving section 33B placed on the movable auxiliary bed 2 is configured using a rotation receiving shaft 39 comprising a key 38 that is fitted in the socket 36 of a power transmission section 32 of the fixed U-shaped bed 1.

Next, we describe the power transmission mechanism of the movable auxiliary bed 2 in detail. A self-lock means 40, which will be described below, is incorporated in conjunction with the first bracket member 30 attached to the body frame of the movable auxiliary bed 2. After the movable auxiliary bed 2 has been changed between its bed form and wheelchair form and the drive source has stopped, the self-lock means 40 automatically maintains the form in a stable condition.

Figure 1B:
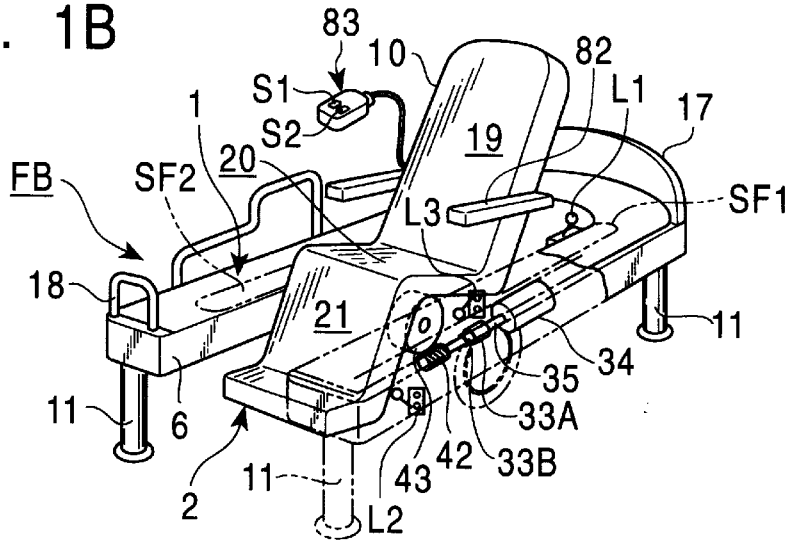
Figure 1C:
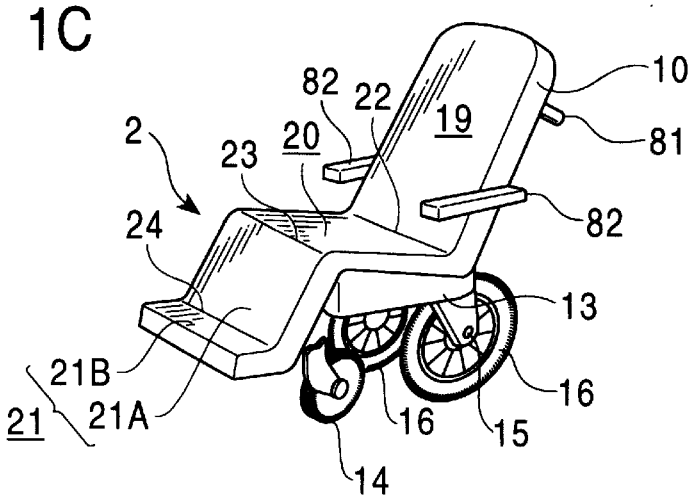

For example, according to the specific embodiment shown in FIG. 1B, in an example of a configuration in which the rotation drive motor 34 is mounted on a lower body section 12 of the fixed U-shaped bed 1 as a drive source, the self-lock means 40, an embodiment of which is shown in FIG. 5 in detail, comprises a worm gear mechanism 41 having a combination of a worm 42 attached to a rotation receiving shaft 39 and a worm wheel 43 attached to a pivot 32 of the first bracket member 30, wherein the worm gear mechanism 41 functions as a very effective self-lock mechanism.

Figure 7:
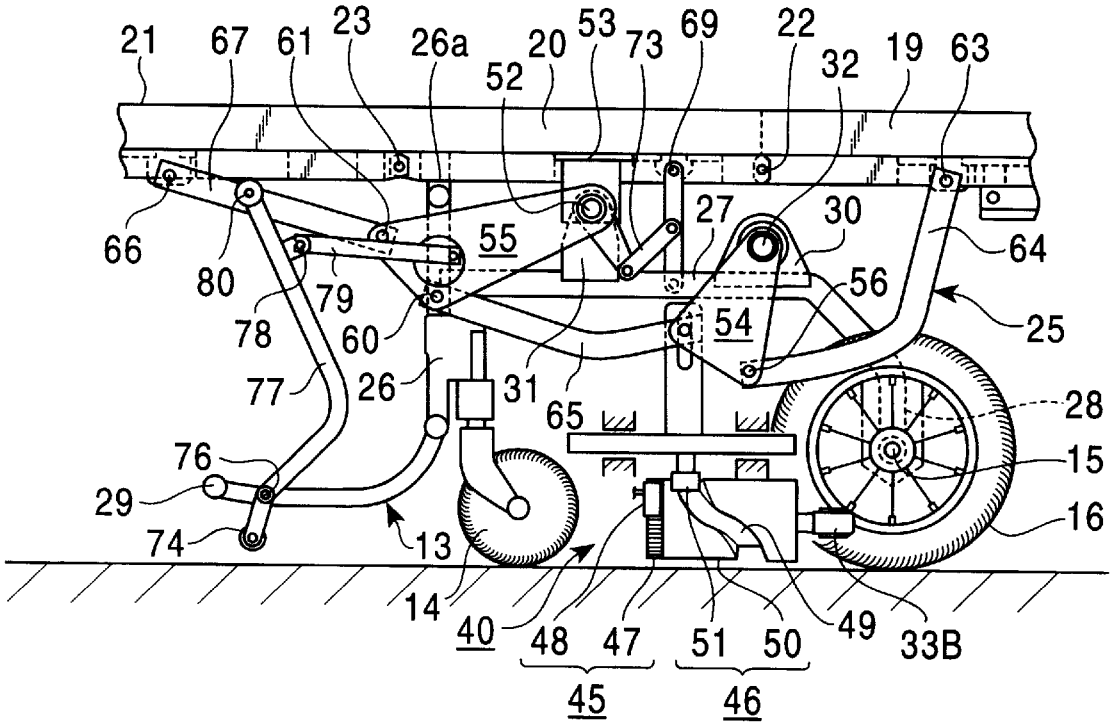
FIG. 7 is schematic side view corresponding to FIG. 2, showing a different embodiment of the self-lock means of the multifunction bed according to the present invention. In the example configuration shown, the self-lock means consists of a cylindrical cam and a one-way clutch.

If the drive source is the rotation drive motor 34, as in the specific embodiment shown in FIG. 7, the self-lock means 40 may be a power transmission mechanism comprising a combination of a one-way clutch mechanism 45 and a cylindrical cam mechanism 46, both attached to the rotation receiving shaft 39. The one-way clutch mechanism 45 comprises a ratchet wheel 47 and a locking claw 48 that are designed to allow rotations in one direction while inhibiting rotations in the other direction. Meanwhile, the cylindrical cam mechanism 46 is composed of a cylinder 50 having a groove 49 in the outer circumferential surface and a slider member 51 that is fitted in a groove 49 in a cylinder 50 and that moves back and forth in the axial direction of the cylinder 50.

Furthermore, if the drive source is a rotation drive motor, the self-lock means 40 may be a power transmission mechanism including a ratchet wheel mechanism or a screw-type power transmission mechanism. Furthermore, if the drive source is a hydraulic drive system, the self-lock means 40 can be configured to include a check valve mechanism for a hydraulic drive system.

Next, we explain a mechanism in the multifunction bed FB according to the present invention that changes the movable auxiliary bed 2 between its horizontal bed form, reclining seat form, and wheelchair form.

An important point of the present invention is that the present invention is configured so that when the movable auxiliary bed 2 is changed from its horizontal bed form through its reclining seat form to its wheelchair form, the person lying on the bed is gradually raised to a sitting position, while when the movable auxiliary bed 2 is being changed to its wheelchair form, the seat section is inclined according to the inclination of the backrest section to allow part of the bed closer to the leg-rest section to be located higher than the opposed part, thereby allowing the buttocks of the person lying on the bed to sink relative to the horizontal bed form.

Based on these ideas, the present invention includes the link mechanism 25 for individually interlocking and connecting the backrest section 19, seat section 20, and leg-rest section 21 of the movable auxiliary bed 2 to the body frame 13. Using the link mechanism 25, the single drive source 34 can deform the horizontal bed section of the movable auxiliary bed 2 into the backrest, seat, and leg-rest sections constituting a wheelchair.

The link mechanism 25 essentially comprises a rotating pivot 32 disposed to a first bracket 30 attached to the body frame 13, and a rotating pivot 52 disposed to a second bracket 31 attached to the body frame 13. Through the rotating pivot 52, the seat section in 20 is rollingly connected to the body frame 13 via a third bracket 53 attached to the bottom surface of the seat section 20 of the movable auxiliary bed 2.

The link mechanism 25 includes a rotational movement member 54 attached to the rotating pivot 32 and a bell crank 55 attached to the rotating pivot 52. The rotational movement member 54 comprises a first pivotal point 56 and a second pivotal point 57 at respective positions located away from the rotating pivot 32, and the bell crank 55 has a first rotational movement piece 58 and a second rotational movement piece 59. The first rotational movement piece 58 has a third pivotal point 60 and a fourth pivotal point 61 at respective positions located away from the rotating pivot 52, and the second rotational movement piece 59 has a fifth pivotal point 62 at a position located away from the rotating pivot 52.

A first link bar 64 pivotably connects the first pivotal point 56 of the rotational movement member 54 of the link mechanism 25 to a pivotal point 63 of the backrest section 19 of the movable auxiliary bed 2. A second link bar 65 pivotably connects between the second pivotal point 57 of the rotational movement member 54 to the third pivotal point 60 of the first rotational movement piece 58 of the bell crank 55. A third link bar 67 pivotably connects the fourth pivotal point 61 of the first rotational movement piece 58 of the bell crank 55 to a pivotal point 66 of the leg-rest section 21 of the movable auxiliary bed 2.

First and a second link pieces 71 and 72 pivotably connected by an intermediate pivotal point 70 connect a pivotal point 68 provided on the body frame 13 to a pivotal point 69 provided on the bottom surface of the seat section 20 of the movable auxiliary bed 2. A third link piece 73 pivotably connects the fifth pivotal point 62 of the second rotational movement piece 59 of the bell crank 55 to the intermediate pivotal point 70 between the first and second link pieces 71 and 72.

Furthermore, according to the present invention, the link mechanism 25 functions to extend and withdraw auxiliary wheels 74 in order to prevent the movable auxiliary bed 2 from toppling forward. That is, a sixth pivotal point 75 is provided on the first rotational movement piece 58 of the bell crank 55 of the link mechanism 25. An auxiliary wheel operating link member 77 is rollingly attached via the pivotal point 76 to the footrest section locking frame section 29 of the body frame 13. A pivotal point 78 is provided on the auxiliary wheel operating link member 77, and a connection link 79 pivotably connects the pivotal point 78 and the sixth pivotal point 75 of the bell crank 55.

Figure 2:
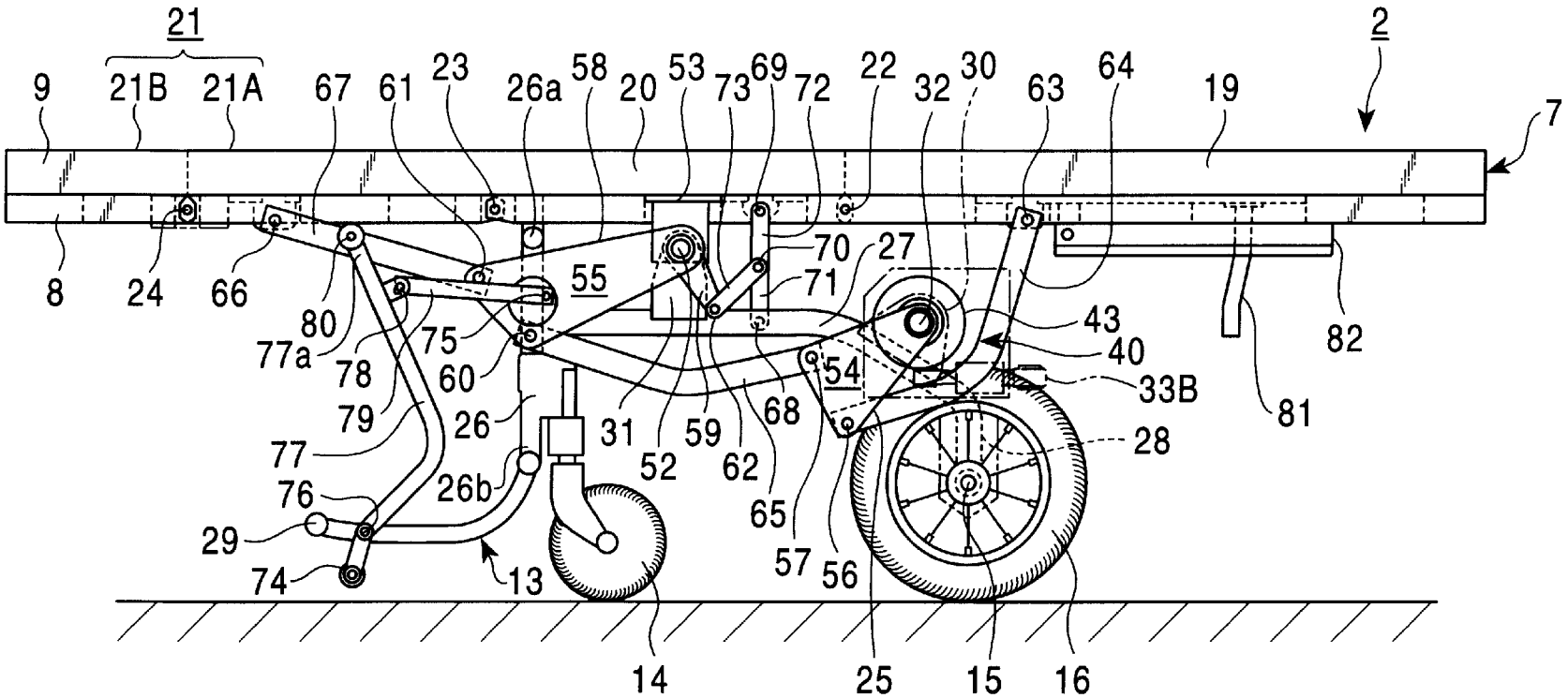
FIG. 2 is a schematic side view showing the movable auxiliary bed in the horizontal bed form, during the process for changing the movable auxiliary bed from its horizontal bed form, through its reclining seat form, to its wheelchair form.
Figure 3:
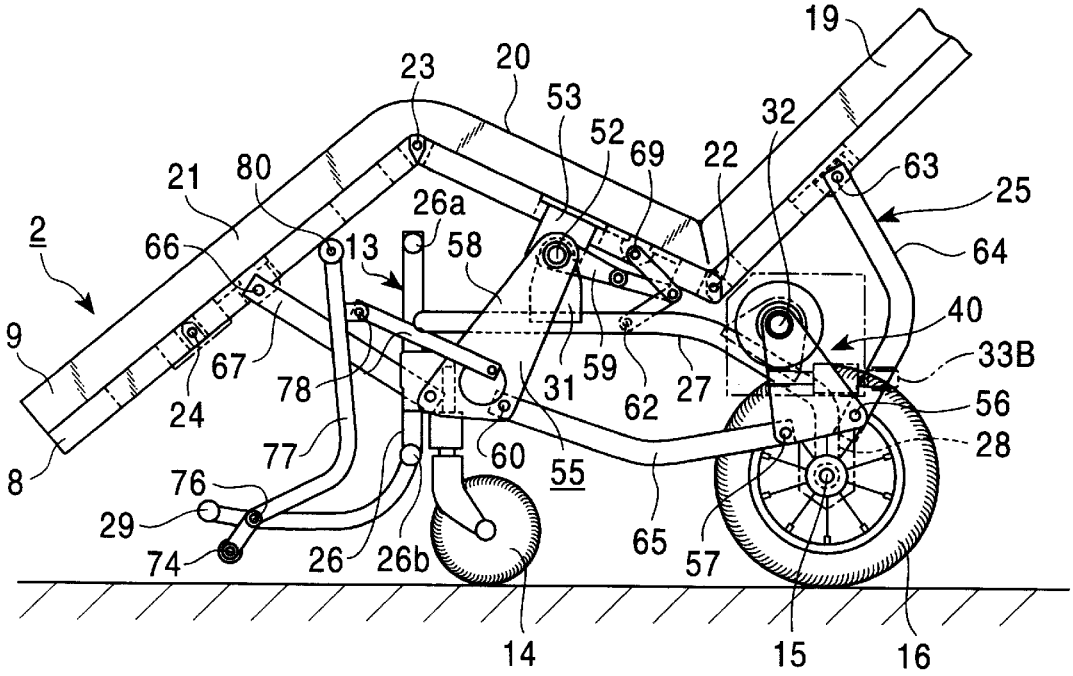
FIG. 3 is a schematic side view showing the movable auxiliary bed in the reclining seat form, during the process for changing the movable auxiliary bed from the horizontal bed form through the reclining seat form to the wheelchair form.

An auxiliary roller 80 is attached to the upper end 77*a* of the auxiliary wheel operating link member 77 and is formed so as to support the bottom surface of the leg-rest section 21 when the movable auxiliary bed 2 is in the horizontal bed form shown in FIG. 2 and the reclining seat form shown in FIG. 3. The auxiliary wheels 74 provided at the lower ends of the auxiliary wheel operating link members 77 are grounded to prevent the movable auxiliary bed 2 from toppling forward.

Figure 4:
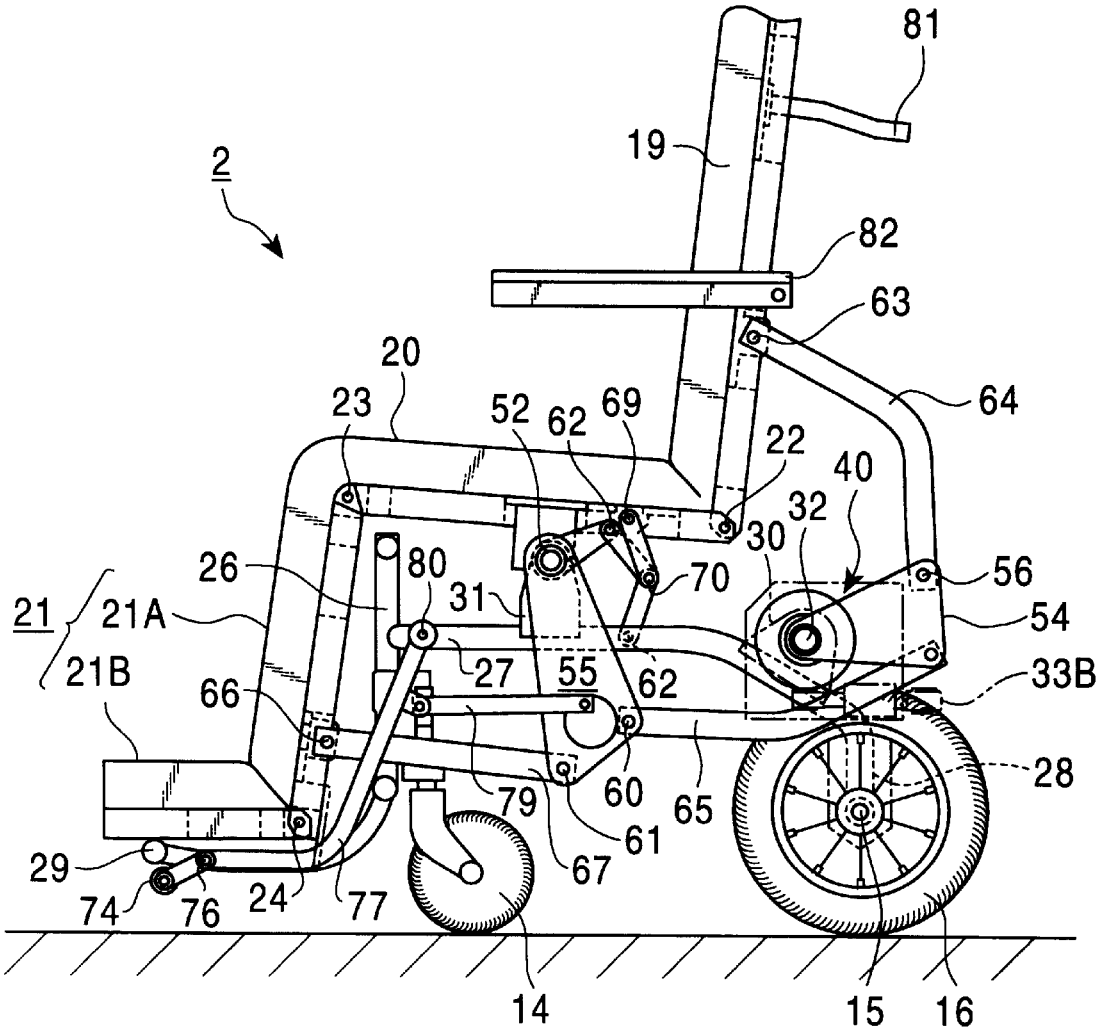
FIG. 4 is a schematic side view showing the movable auxiliary bed in the wheelchair form, during the process for changing the movable auxiliary bed from the horizontal bed form through the reclining seat form to the wheelchair form.

With the link mechanism 25, if the movable auxiliary bed 2 is changed from the horizontal bed form shown in FIG. 2 through the reclining seat form shown in FIG. 3 to the wheelchair form shown in FIG. 4, the drive source 34 is driven to rotate the rotational movement member 54 counterclockwise around the rotating pivot 32 via the power transmission sections 33A and 33B and self-lock mechanism 40. In this case, the backrest section 19 of the movable auxiliary bed 2 is pressed around the joint-like connection means 22 via the first link bar 64, in the direction in which this section stands up.

When the rotational movement member 54 rotates counterclockwise, the bell crank 55 is drawn by the second link bar 65 to rotate counterclockwise around the rotating pivot 52. In this case, the seat section 20 of the movable auxiliary bed 2 is drawn via the first and second link pieces 71 and 72 linking the seat section 20 with the body frame 13 and the third link piece 73 connected to the out put side of the second rotational movement piece 59 of the bell crank 55. Thus, the seat section 20 rotates clockwise around the rotating pivot 52 to allow a backrest section connection side of the seat section 20 to sink while elevating a leg-rest section connection side of the seat section 20.

On the other hand, at this point, the leg-rest section 21 of the movable auxiliary bed 2 is drawn in via the third link bar 67 connected to the first rotational movement piece 58 of the bell crank 55 and moves counterclockwise around the joint-like connection section 23.

Furthermore, if the drive source 34 operates to change the movable auxiliary bed 2 from the reclining seat form shown in FIG. 3 to the wheelchair form shown in FIG. 4, the backrest section 19 and leg-rest section 21 of the movable auxiliary bed 2 are displaced counterclockwise as described above. At this point, however, the set section 20 of the movable auxiliary bed 2 is displaced in a direction opposite to the above displacement direction, due to the operation of the third link 73 connected to the output side of the second rotational movement piece 59 of the bell crank 55, and to the operation of the first and second link pieces 71 and 72 linking the body frame 13 with the seat section 20. Consequently, the seat section 20 is displaced again into an approximately horizontal state.

The change from the wheelchair form to the horizontal bed form shown in FIG. 4 is carried out using a procedure reverse to the above one. When the movable auxiliary bed 2 is fitted in the fixed U-shaped bed 1 to return to the original horizontal position, the user sitting in the wheelchair automatically returns to a lying position. In FIG. 4, reference numeral 81 is an operation handle comprising a brake means, and reference numeral 82 is an armrest member. The armrest member 82 is housed in the rear of the backrest section 19 of the wheelchair and is configured to extend from the rear in the wheelchair form.

Figure 6A:
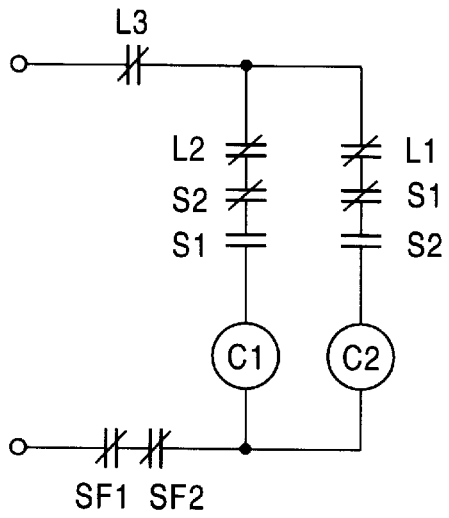
FIGS. 6A and 6B show a drive control system for the multifunction bed according to the present invention.
Figure 6B:
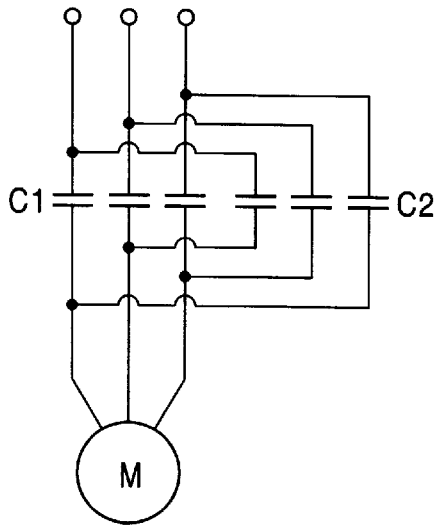

In order to operate the drive source and control its safety, the multifunction bed FB according to the present invention incorporates various means shown in FIGS. 1B and 6. According to the present invention, the multifunction bed FB comprises a button switch means 83 operated by a person lying on the bed or by a nurse. The button switch means 83 includes an elevation switch S1 for changing the movable auxiliary bed 2 from its horizontal bed form to its wheelchair form and a lowering switch S2 for changing the bed 2 from its wheelchair form to its horizontal bed form.

Furthermore, according to the present invention, there are installed in the U-shaped cut-out section 6 of the fixed U-shaped bed 1, a first limit switch L1 for detecting the lowest position condition in which the movable auxiliary bed 2 has been changed to the horizontal bed form, a second limit switch L2 for detecting the highest position condition in which the movable auxiliary bed 2 has been changed to the wheelchair form, and a connection confirmation limit switch L3 for confirming the connection condition of the movable auxiliary bed 2. Furthermore, for safety, plate-like safety switches SF1 and SF2 are provided in a mat surface section along the U-shaped cut-off section 6 of the fixed U-shaped bed 1 to prevent the user from being caught therein.

As is apparent from the circuit diagram shown in FIG. 6, these switches are connected so as to be activated by simply operating the button switch means 83, and are formed to control the drive source so as to confirm and detect each position and to control it immediately if an accident occurs, for example, the user is caught anywhere in the bed.

Figure 8:
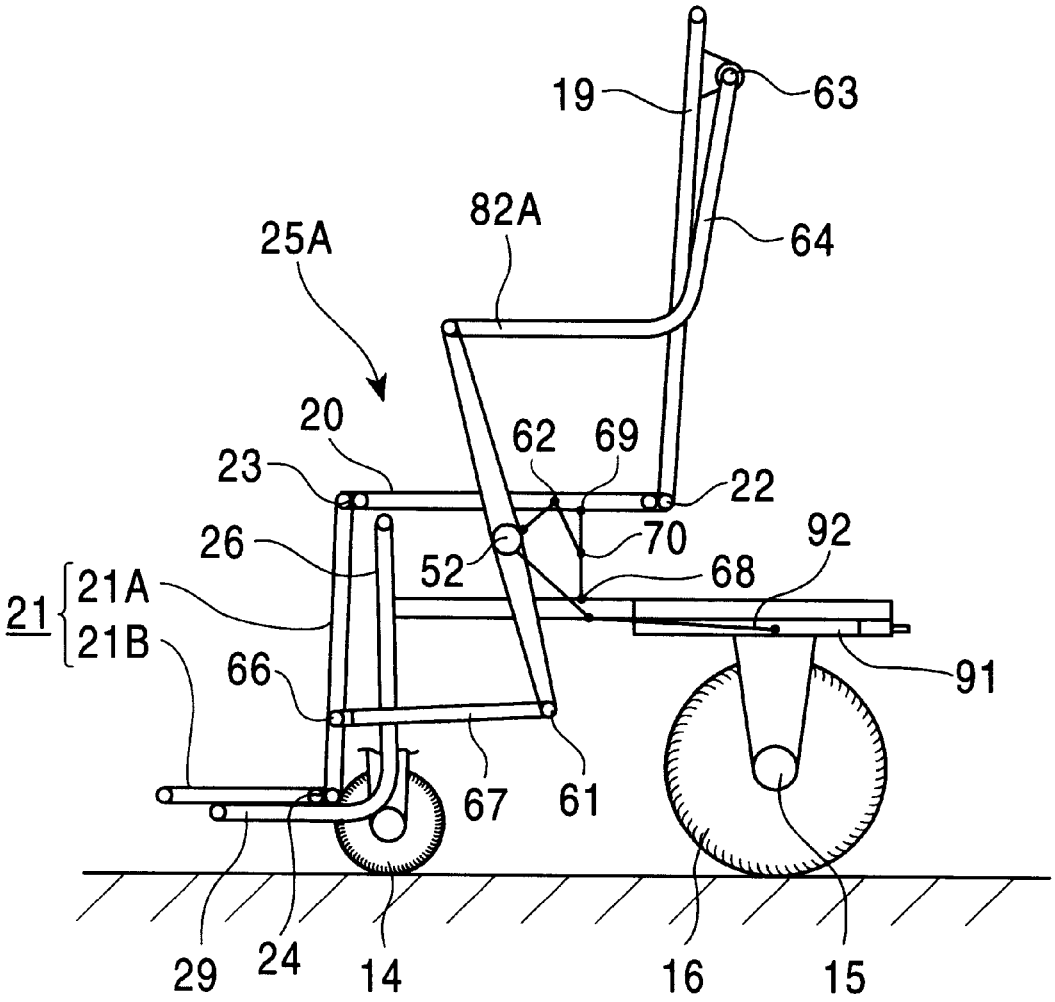
FIG. 8 is a schematic side view corresponding to FIG. 4, showing a different example of a link mechanism mounted on the movable auxiliary bed. In the example configuration shown, an armrest section functioning as part of the wheelchair form is operated by link connections.
Figure 9A:
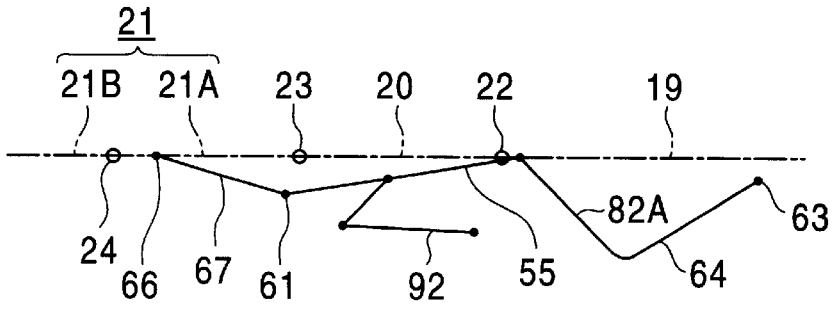
FIGS. 9A, 9B and 9C are is a diagrams describing an operational aspect of the link mechanism on the movable auxiliary bed having the embodiment shown in FIG. 8.
Figure 9B:
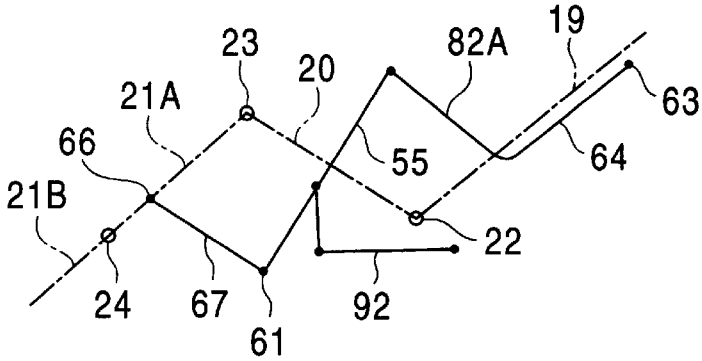
Figure 9C:
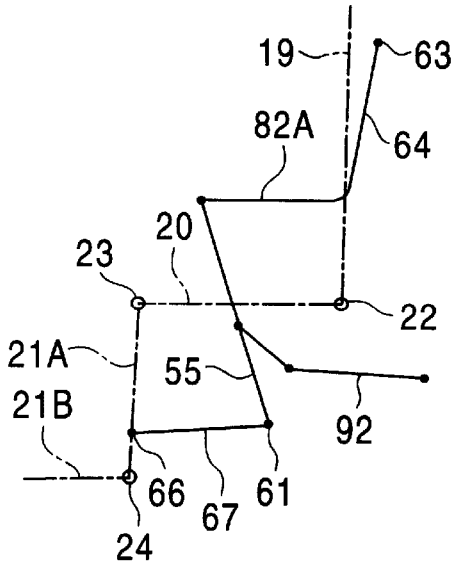

FIGS. 8 and 9 show another embodiment of the movable auxiliary bed according to the present invention. A movable auxiliary bed 2A in this example has essentially the same main components as in the above embodiment shown in FIGS. 1 to 6 and is described above, except that an armrest 82A is adapted to automatically extend and withdraw as part of a link mechanism 25A and that rear wheels 16A are supported by a slider member and slide in response to an operation of a slide operating link 92 of the link mechanism 25A.

Figure 10:
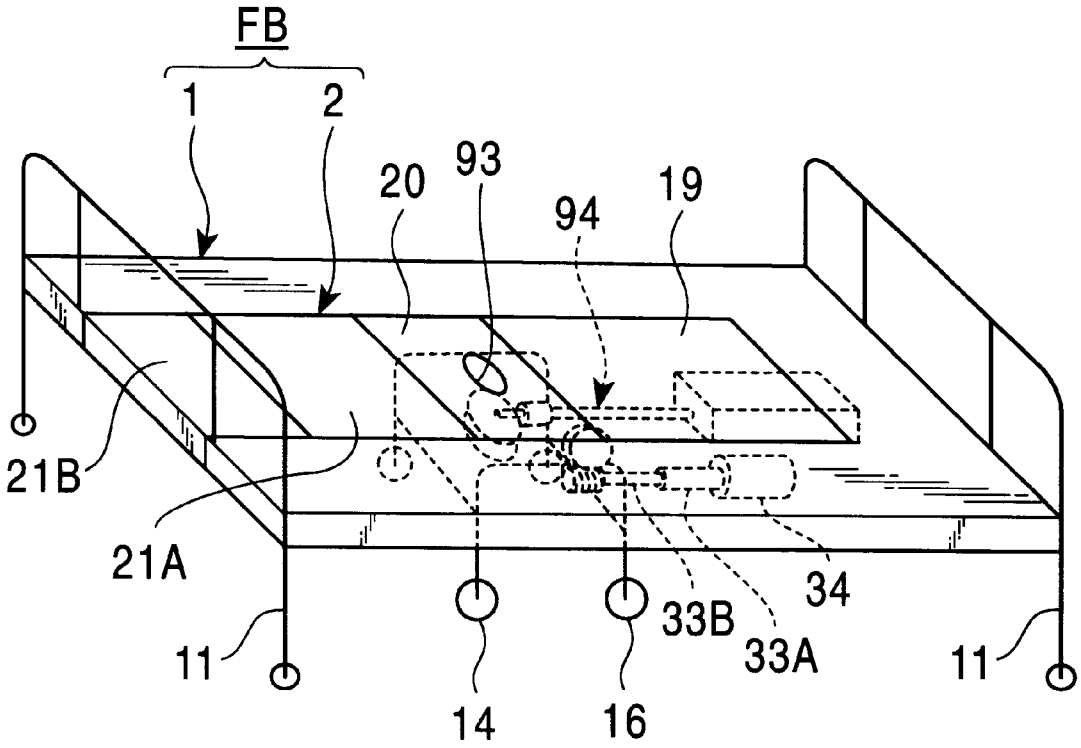
FIG. 10 is a schematic perspective view showing the multifunction bed according to the present invention with another configuration added thereto, in the specific example shown, the multifunction bed is configured so that a user can eliminate solid waste while lying on the bed.
Figure 11:
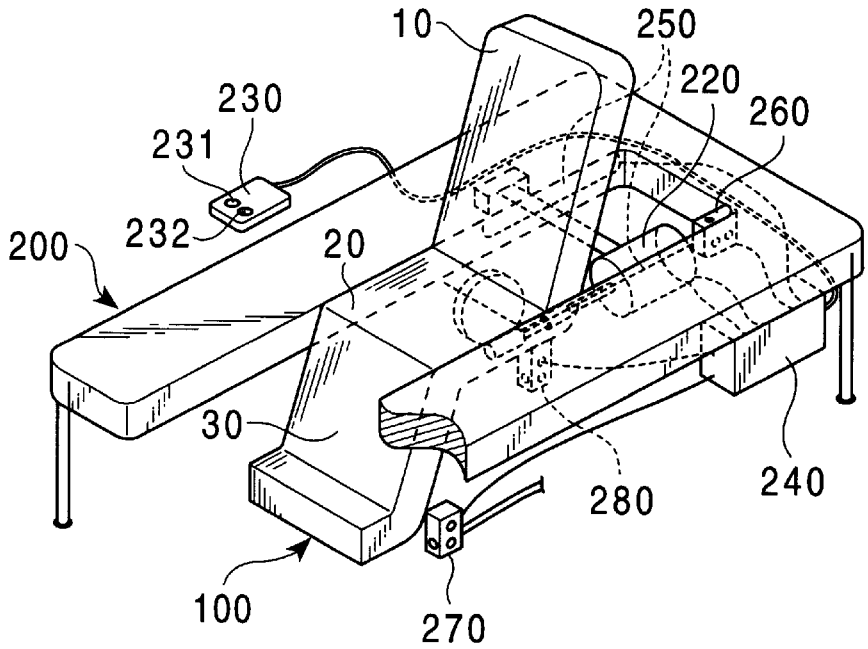
FIG. 11 is a schematic view showing a control system according to the present invention.

FIG. 10 shows the multifunction bed according to the present invention with another configuration added thereto, such that a user can eliminate solid waste while lying on the bed. According to the multifunction bed in this example, an excretion hole 93 is provided in the seat section of the movable auxiliary bed to allow a user to dispose of excrement, and a flush toilet device with a flushing function 94 is provided in the underlying body section opposed to the excretion hole 93. The excretion hole 93 is formed so as to be opened and closed by an appropriate opening and closing means.

The multifunction bed according to the present invention described above is composed of two elements, that is, the fixed U-shaped bed and the movable auxiliary bed. Thus, this multifunction bed has a simple structure to allow its size and cost to be reduced within required ranges, and can be automatically and very simply changed between its bed form, reclining seat form, and wheelchair form. In addition, these changes can be made reliably and safely. Therefore, this multifunction bed is very effective.

Furthermore, according to the multifunction bed of the present invention, when the person lying on the bed simply touches the switch, the movable auxiliary bed can be changed from the horizontal bed form through the reclining seat form to the wheelchair form, thereby saving energy. Accordingly, this multifunction bed is very effective as a nursing bed for those who require nursing.

Furthermore, the multifunction bed according to the present invention employs a specially designed link mechanism. Thus, in order to prevent the person lying on the bed from being pushed forward while the movable auxiliary bed is being changed to the wheelchair form, the seat section is inclined according to the inclination of the backrest section so that part of the seat section closer to the leg-rest section is located higher than the opposed part, thereby allowing the buttocks of the person lying on the bed to sink relative to the horizontal bed form. Consequently, this multifinction bed is very effective in terms of safety as well.

Furthermore, the multifunction bed according to the present invention has a self-lock means in conjunction with a power transmission section. Thus, after the bed form has been changed to the wheelchair form and when the drive source is stopped, the form is automatically maintained in a stable condition. Again, this multifunction bed is very effective in saving energy.

Next, the effects of the switches for controlling safety are described in detail.

Figure 12A:
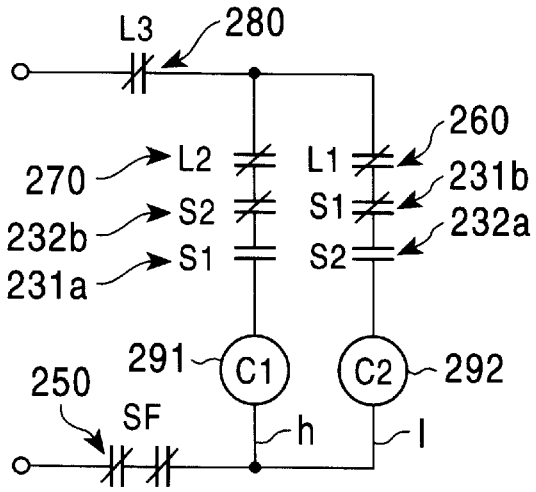
FIG. 12 is a circuit diagram of the control system in FIG. 11.

As shown in FIG. 12A, this control circuit is composed of two control lines, that is, an elevation control line h and a lowering control line 1. The elevation control line h is connected to a first conductor (C1) 291 for switching a contact so as to elevate the backrest surface section, a normal open relay contact 231*a* connected to an elevation switch (S1), a normal closed relay contact 232*b* connected to a lowering switch (S2), and a normal closed relay contact 270 connected to the highest position limit switch (L1). In addition, the lowering control line 1 has connected thereto a second conductor (C2) 292 for switching a contact so as to lower the backrest surface section, a normal open relay contact 232*a* connected to the lowering switch (S2), a normal closed relay contact 231*b* connected to the elevation switch (S1), and a normal closed relay contact 260 connected to the lowest position limit switch (L1). The elevation switches 231*a* and 231*b* of both control lines are interlocked with each other, and the lowering switches 232*a* and 232*b* of both control lines are interlocked with each other. Furthermore, the elevation control line h and the lowering control line 1 are connected together via a normal closed switch 280 connected to a tape switch (SF) 250 and a specified-position confirmation switch (L3).

Figure 12B:
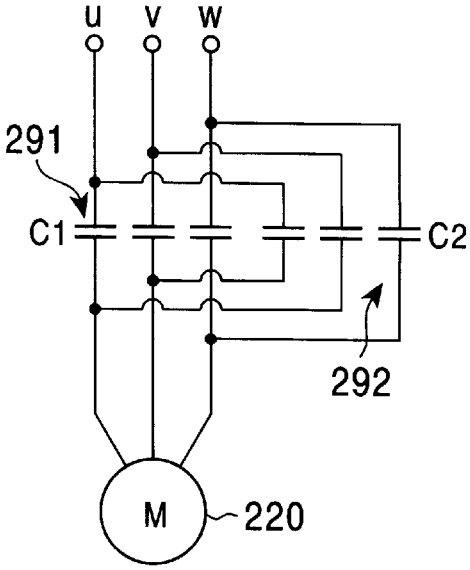

Furthermore, in FIG. 12B, the first conductor (C1) 291 and the second conductor (C2) 292 are configured to be connected among three-phase alternating current wires u, v, and w connected between a power supply and a drive motor 220, so as to switch the contact between any two of the wires. The first conductor (C1) 291 electrically connects the u and w wires, and the second conductor (C2) 292 electrically connected the u and w wires.

Next, the effects of the multifunction bed are explained.

To change the wheelchair from the bed form to the reclining seat form, a nurse or a user continues to press the elevation switch 231 in a stand and lie controller 230. During this operation, the S1 contact 231*a* shown in FIG. 12A is closed to energize the elevation control line (h) to electrically connect together the u and w wires shown in FIG. 12B, thereby rotating the drive motor 220 in a forward direction. Thus, a backrest surface section link arm 64 of a head-side link mechanism 54 is moved toward the head side via a transmission mechanism 43, which is shown in FIG. 2, to press the backrest surface section 19 up to an arbitrary height on an incline. In addition, an interlocking link arm 65 of the head-side link mechanism 55 is simultaneously moved to the head side to rotate a foot-side link mechanism 55. This rotation moves a footrest surface section link arm 67 toward the head side to pull up the footrest surface section 21 on an incline, thereby arranging the backrest surface section 19, the seat surface section 20, and the footrest surface section 21 somewhat in tiers. When the elevation switch 231 is released, the contact 231*a* is opened to disconnect the control circuit. Then, the transmission mechanism 43 maintains the wheelchair at the same inclination. At this point, an inclination adjustment link 59 bends a horizontal adjustment link 72 to slightly incline the seat surface section 20 toward the head side and then supports it. Consequently, the seat surface section 20 stably supports the waist of the lying person, while the backrest surface section 19 and the footrest surface section 21 are inclined, thereby enabling the lying person to assume a desired reclining position.

Furthermore, to change the wheelchair from the reclining seat form to the wheelchair form, the nurse or user further continues to press the elevation switch 231 in the stand and lie controller 230. During this operation, the S1 contact 231*a* shown in FIG. 12A is closed to energize the elevation control line h to electrically connect together the u and w wires shown in FIG. 12B, thereby rotating the drive motor 220 in a forward direction. Thus, the backrest surface section link arm 64 of the head-side link mechanism 54 is moved toward the head side via the transmission mechanism 43 to further push up the backrest surface section 19 so as to stand almost perpendicularly. Then, the footrest surface section 21 comes in contact with the highest limit switch 270 to open an L2 contact 270, which is shown in FIG. 12A, to disconnect the elevation control line h. At the same time, the interlocking link arm 65 of the bead-side link mechanism 54 is moved to the head side to rotate the foot-side link mechanism 55. This rotation moves the footrest surface section link arm 67 toward the head side to further pull up the footrest surface section 21 so as to stand almost perpendicularly, thereby arranging the backrest surface section 19, the seat surface section 20, and the footrest surface section 21 in tiers. Then, the transmission mechanism 43 maintains the wheelchair at the same inclination. At this point, the inclination adjustment link 59 bends the horizontal adjustment link 72 so as to stand linearly again, thereby returning the seat surface section 20 to an almost horizontal position, where it is supported.

In addition, to change the wheelchair from the wheelchair form to the bed form, the wheelchair is guided to a predetermined position of the bed body, and a male joint and a female joint are connected together and retained by a guide.

Subsequently, the nurse or user continues to press the lowering switch 232 in the stand and lie controller. During this operation, the S2 contact 232*a* shown in FIG. 12A is closed to energize the lowering control line 1 to electrically connect together the v and w wires shown in FIG. 12B, thereby rotating the drive motor 220 in a forward direction. Thus, the backrest surface section link arm 64 of the head-side link mechanism is moved toward the foot side via the transmission mechanism 43 to pull up the backrest surface section 19 so as to lie horizontally. Then, the backrest surface section 19 comes in contact with the lowest limit switch 260 to open an L1 contact 260, which is shown in FIG. 12A, to disconnect the lowering control line 1. At the same time, the interlocking link arm 65 of the head-side link mechanism 54 is moved to the foot side to rotate the foot-side link mechanism 55. This rotation moves the footrest surface section link arm 67 toward the foot side to push up the footrest surface section 21 so as to lie horizontally, thereby arranging the backrest surface section 19, the seat surface section 20, and the footrest surface section 21 in the horizontal direction. Then, the transmission mechanism 43 retains the wheelchair. At this point, the inclination adjustment link 59 bends the horizontal adjustment link 72 so as to stand linearly, thereby supporting the seat surface section 20 in the horizontal direction.

In addition, while the wheelchair is being changed from the wheelchair form to the bed form and if the user's hand is caught between the wheelchair and the bed body, a tape switch 250 opens a contact, which is shown in FIG. 12A, to forcibly disconnect the lowering control line 1, thereby forcing the driving of the drive motor 220 to be stopped. Consequently, the user can operate the stand and lie switch without the need to be watched by the nurse and can assume a desired reclining position.

Next, the other embodiments of the present invention are described in detail with reference to the accompanying drawings.

Figure 17:
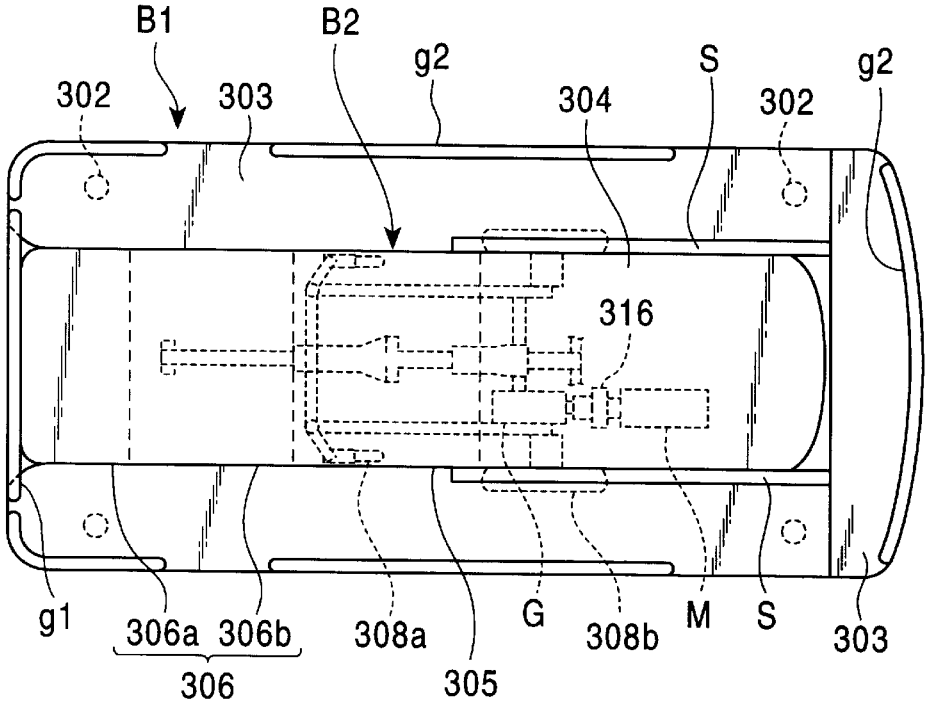
FIG. 17 is an overall top view showing the multifunction bed according to the present invention.
Figure 18:
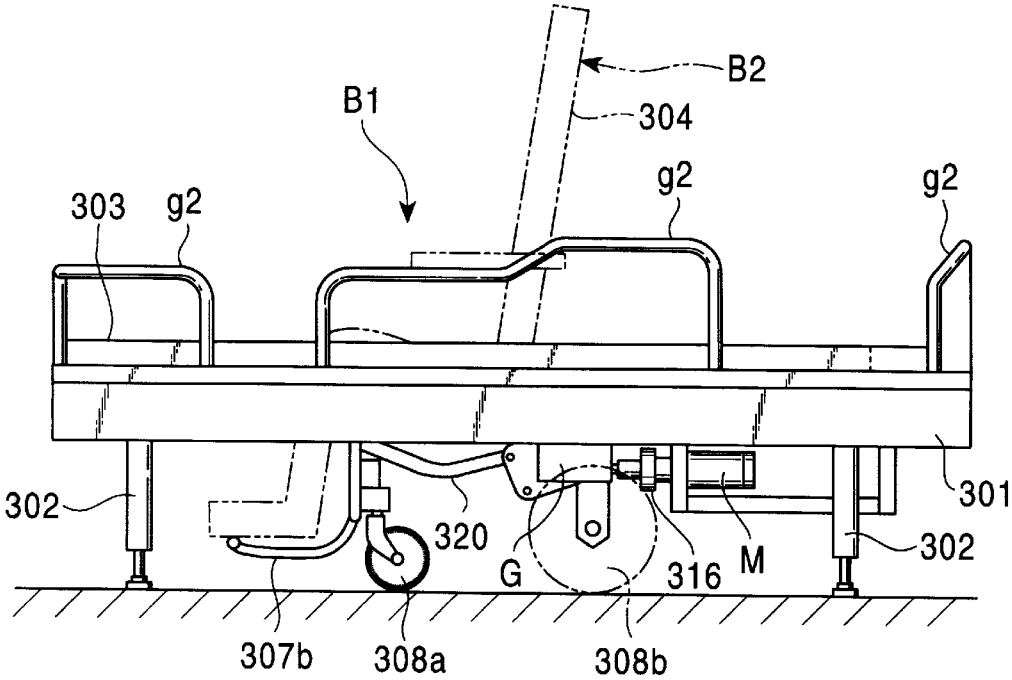
FIG. 18 is an overall side view showing the multifunction bed according to the present invention.

FIGS. 17 and 18 are overall top and side views of a multifunction bed according to the present invention. As shown in the figures, this multifunction bed is composed of a fixed U-shaped bed B1 having a cut-out section that appears U-shaped in a top view and a movable auxiliary bed B2 that is detachably fitted in the U-shaped cut-out section of the fixed U-shaped bed B1.

The fixed U-shaped bed B1 comprises a body frame 301, a leg section 302, a mat 303 laid on both sides and head position of the bed, an inlet guard g1 detachably provided on the foot side of the fixed U-shaped bed B1 that is an opening side, a fixed guard g2 placed around the fixed U-shaped bed B1, and a motor M or the like acting as a drive source for changing the form of the movable auxiliary bed B2. The movable auxiliary bed B2 comprises a floor section configured by foldably connecting a backrest section 304, a seat section 305, and a footrest 306 and is connected to the motor M so as to be changed within the fixed U-shaped bed B1 between a bed form forming a flat floor section and a wheelchair form forming a seat surface, via a gear and a link mechanisms, which will be described below. In the FIGS. 17 and 18, reference numeral 1*a* is a wheel guide attached to the inner surface of the fixed U-shaped bed B1 on the opening side, and reference S is a tape-shaped safety switch for detecting whether the user's hand is caught between the U-shaped cut-out section of the fixed U-shaped bed B1 and the backrest section 304 of the movable auxiliary bed B2.

Figure 13:
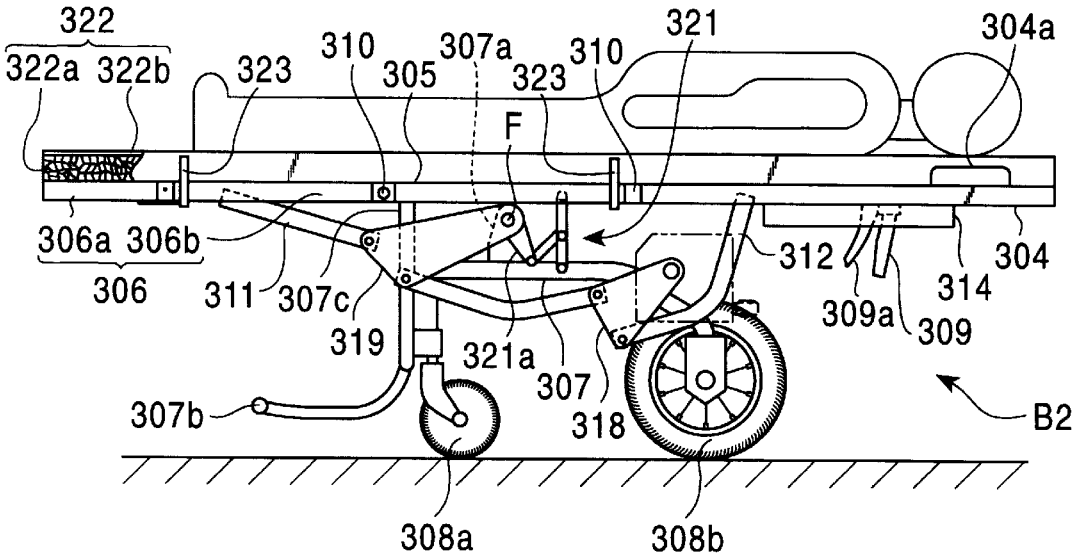
FIG. 13 is an overall side view showing the bed form of the movable auxiliary bed.
Figure 14:
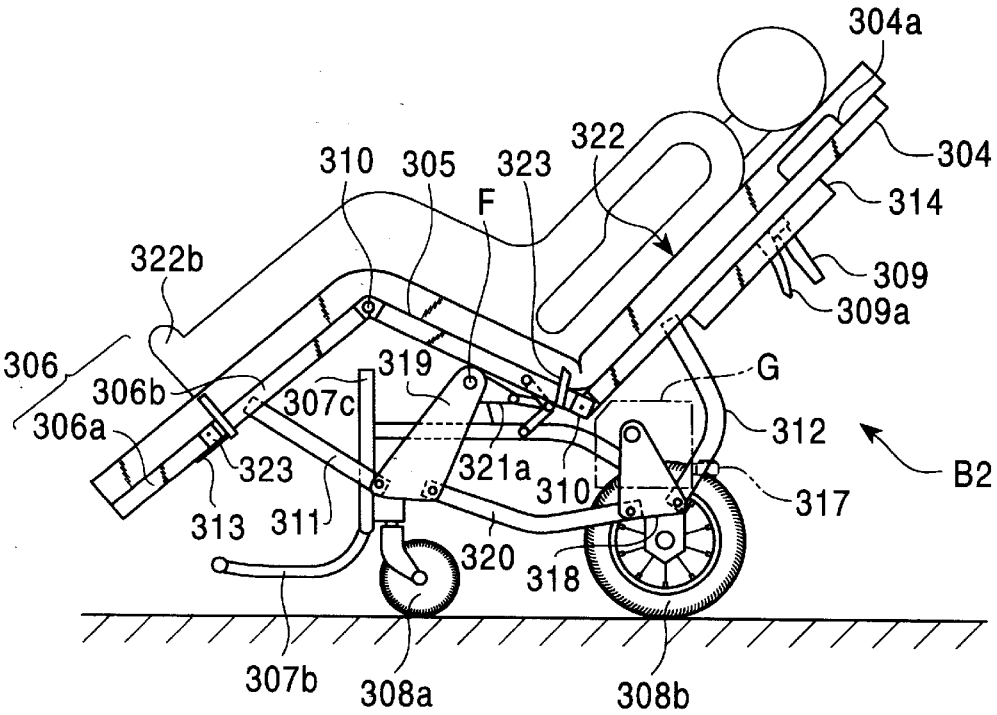
FIG. 14 is an overall side view showing the reclining seat form of the movable auxiliary bed.
Figure 15:
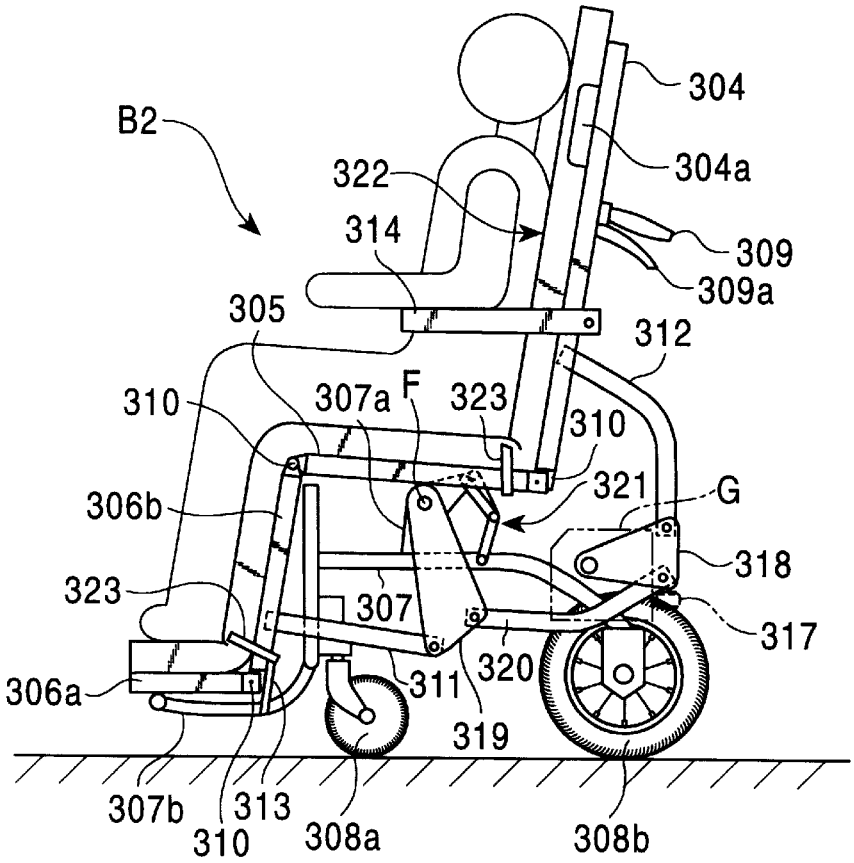
FIG. 15 is an overall side view showing the wheelchair form of the movable auxiliary bed.
Figure 16:
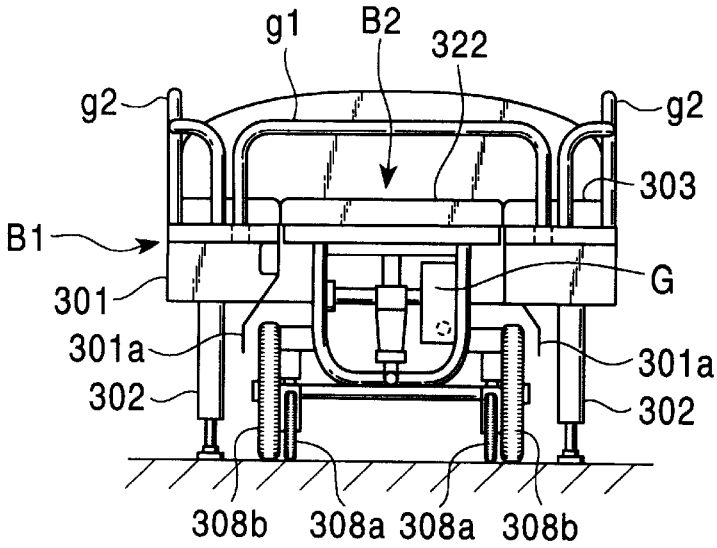
FIG. 16 is a partly cutout front view showing the multifunction bed according to the present invention.

FIGS. 13 to 15 show the bed form, reclining seat form, and wheelchair form of the movable auxiliary bed B2, respectively. A configuration of the movable auxiliary bed B2 is described in detail with reference to the drawings. The movable auxiliary bed B2 comprises castor-shaped front wheels 308*a* and rear wheels 308*b* as loosely rotating wheels in the front and rear of a body frame 307, so that a nurse can directly use the movable auxiliary bed B2 in its bed form as a stretcher to transfer a patient, or can use a handle 309 attached to the rear surface of the backrest section 304 to move the movable auxiliary bed B2 when in its wheelchair form. As described above, the floor section of the movable auxiliary bed B2 is divided into the backrest section 304, the seat section 305, and the footrest 306, with the divided sections foldably connected together via hinges 310. The floor section configured in this manner rollingly supports the seat section 305 around a fulcrum F formed by a bracket 307*a* fixed at the center of the body frame 307, and pivots the footrest 306 and the backrest section 304 using a front link 311 and a rear link 312, respectively.

The footrest 306 is divided into a leg section 306*b* and a step 306*a* adapted to maintain its horizontal position by means of a receiving member 313 extending from the leg section 306*b* beyond the hinge 310. An auxiliary frame 307*b* shaped like a beetle's horn and which appears T-shaped in a top view extends from the front end of the body frame 307. After the movable auxiliary bed has been changed to the wheelchair form, the step 306*a* abuts on the auxiliary frame 307*b*, which thus automatically folds to receive the step 306*a*. A support frame 307*c* that receives the seat section 305 in the bed form extends from the front end of the body frame 307 and opposite to the auxiliary frame 307*b*. An armrest 314 used in the wheelchair form is stored in the rear surface of the backrest section 304. Furthermore, the bed comprises a brake mechanism (not shown in the drawings) operated by a brake lever 309*a* to brake the rear wheels 308*b* and a safety brake (not shown in the drawings) that establishes the position of the movable auxiliary bed B2 when it is fitted in the fixed U-shaped bed B1 and that maintains safety in the wheelchair form.

Next, a worm gear mechanism 315 and a link mechanism for changing the form of the movable auxiliary bed B2 are explained.

Figure 19:
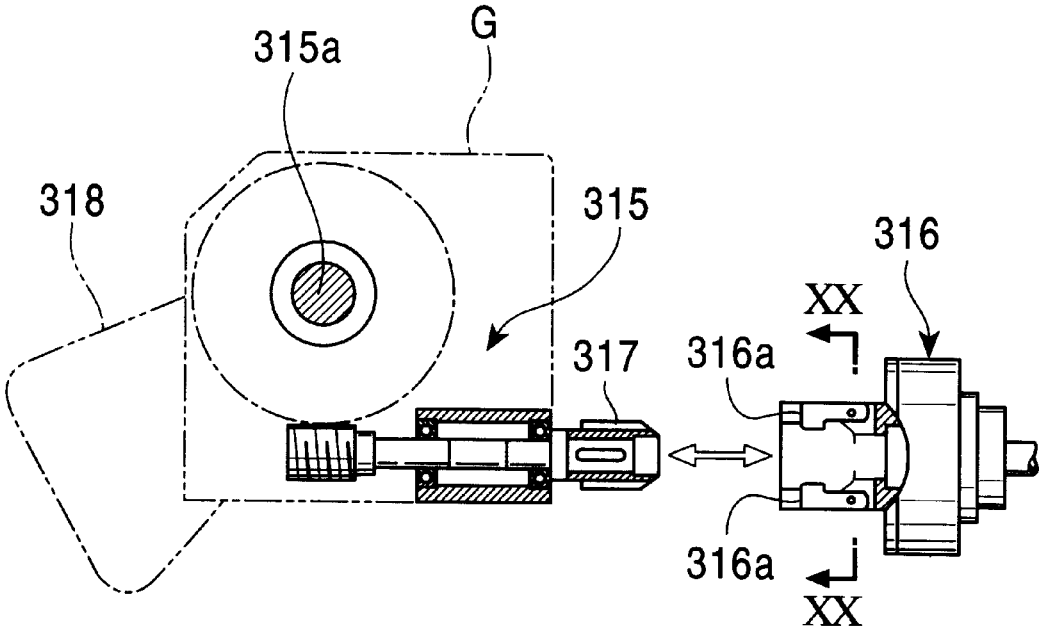
FIG. 19 is a partly cutout front view showing a coupling section of a worm gear mechanism and a motor.
Figure 20:
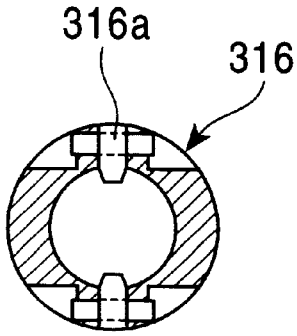
FIG. 20 is a sectional view taken along line XX—XX in FIG. 19.

A gear box G in which the worm gear mechanism 315 shown in FIG. 19 is installed is mounted on the body frame 7 of the movable auxiliary bed B2. An input shaft 317(a spline shaft) that is connected to a coupling 316 of the motor M provided in the fixed U-shaped bed B1 projects from the rear end of the gear box G. As shown in FIG. 20, the coupling 316 has a claw 316*a* that engages with a spline groove in the input shaft 317 and that is urged in the projecting direction by a spring (not shown in the drawings). Thus, the input shaft 317 is pressed in to enter the coupling 316 in an free rotation position, and the motor M is rotated to automatically engage the claw 316*a* with the spline groove in the input shaft 317 for power transmission.

A drive arm 318 of the link mechanism for changing the form of the movable auxiliary bed B2 is attached to a drive shaft 315*a* of the worm gear mechanism 315 so as to rotationally move integrally with the drive shaft 315*a*. This link mechanism comprises the drive arm 318, a first arm 319 that rolls around the fulcrum F of the bracket 307*a* fixed to the center of the body frame 307, a rear link 312 pivotably supporting the drive arm 318 and the backrest section 304, an intermediate link 320 pivotably supporting the drive arm 318 and the first arm 319, and the front link 311 pivotably supporting the first arm 319 and the footrest 306. Furthermore, a link mechanism 321 is provided wherein when the movable auxiliary bed is changed to the wheelchair form, the rear of the seat section 305 is lowered to prevent a person lying on the bed from being pushed forward. The sinking link mechanism 321 is composed of an auxiliary arm 321*a* that rolls integrally with the first arm 319, a buckling link pivotably supported between the seat section 305 and the body frame section 307, and a link linking the buckling point of the buckling link with auxiliary arm.

The floor section of the movable auxiliary bed B2 and a mat 322 laid on the floor section are now described.

The floor section of the movable auxiliary bed B2 divided into the backrest section 304, the seat section 305, and the footrest 306 is formed of a light material such as resin or aluminum, and the top surface of the backrest section 304 is formed to be smooth. The integral mat 322 having no seam from the leg section to the head section is laid on the top surface of the floor section of the movable auxiliary bed B2 formed as described above. The mat 322 comprises a mat body 322*a* that is configured by fusing spring-like resins together and that has a high permeability, an appropriate strength, and a cushion property, and a thin non-woven fabric 322*b* and a cover both covering the mat body. Using attachment strings 323, 323, the mat 322 is tied to the floor section of the bed in the neighborhood of the hinge 310 corresponding to the bucking point between the backrest section 304 and the seat section 305 and the neighborhood of the hinge 310 corresponding to the bucking point between the step 306*a* and leg section 306*b* constituting the footrest 306. Furthermore, considering the distance between the attachment string at the center of the floor section and the head of the mat 322, a guide 304*a* for restraining protrusion from the side of the mat is provided on the side of the bed floor section near the upper end of the backrest section 304 in order to guide the sliding of the mat 322 on the backrest section 304.

Next, an operation of the multifunction bed is described.

With the multifunction bed configured as described above, when the movable auxiliary bed B2 is fitted in the fixed U-shaped bed B1, a user can rest comfortably using the wide floor section surface. Then, for example, to change the movable auxiliary bed to the reclining seat form shown in FIG. 14, an elderly person or other patient lying on the bed, or a nurse presses a button switch (not shown in the drawings) provided in the fixed U-shaped bed B1 to drive the motor M to roll the drive arm 318 and the interlocking first arm 319 and auxiliary arm 321*a* counterclockwise. This rolling changes the movable auxiliary bed to its reclining seat form in which the entire floor section is Z-shaped. That is, the backrest section 304 is folded and pushed up relative to the seat section 305. Due to the folding of the sinking link mechanism 321, the seat section 305 rolls clockwise around the fulcrum F, and in combination with the operation of the backrest section 304, allows the buttocks of the patient lying on the bed to sink, preventing the patient from being pushed forward. The footrest section 306 is folded relative to the seat section 305. Once an appropriate position has been established, the button switch is operated to stop the driving of the motor M and the self-lock mechanism of the worm gear mechanism 315 automatically maintains the position obtained after the form change.

When the button switch is further pressed after the establishment of the reclining seat form, the movable auxiliary bed is changed to its wheelchair form in which the entire floor section is W-shaped, as shown in FIG. 15. That is, in the state shown in FIG. 14, the drive arm 318 and the interlocking first arm 319 and auxiliary arm 321*a* start to roll counterclockwise to cause the backrest section 304 and the footrest 306 to stand up, whereas the auxiliary arm 321*a* sinks beyond the height of the fulcrum F to reduce the folding of the link mechanism 321, thereby allowing the seat section 305 to approach a horizontal condition. At this point, the step 306 of the footrest 306*a* abuts on the tip of the auxiliary frame 307*b* and then automatically folds. The upper limit position for the rolling of the drive arm 318 is detected by the switch (not shown in the drawings) so that once the movable auxiliary bed has been changed to the wheelchair form shown in FIG. 15, further operations of the button switch are canceled.

After the form change, the nurse removes the inlet guard g1 of the fixed U-shaped bed B1, releases the safety brake described above, and uses the handle 309 to move the movable auxiliary bed B2, which has now been changed to its wheelchair form. This movement releases the coupling between the input shaft 317 of the worm gear mechanism 315 and the coupling 316 of the motor M, and the self-lock mechanism automatically maintains the position obtained after the form change, as described above. To change the form of the movable auxiliary bed B2 at a distance from the fixed U-shaped bed B1, an manual operation handle may be installed on the input shaft 317 for manual operation.

After the operation, the nurse returns the movable auxiliary bed B2 to the position of the fixed U-shaped bed B1 and presses in the movable auxiliary bed B2 up to the terminal of the cut-out section that appears U-shaped in a top view. Then, the input shaft 317 at the rear end of the gear box G automatically engages the coupling 316 of the fixed U-shaped bed B1 for power transmission. A switch is provided that is turned on when the movable auxiliary bed B2 is installed in the fixed U-shaped bed B1 in a regular position relationship, this switch must be turned on before the motor can be driven. After applying the safety brake on the movable auxiliary bed B2 to fix the position, either the elderly patient from a sitting position or the nurse places the button switch (not shown in the drawings) in its lowering position to drive the motor M in the reverse direction, in order to move the movable auxiliary bed through its reclining seat form to its bed form. Of course, the lower limit position of the drive arm 318 is again detected by the switch so that once the movable auxiliary bed has been changed to the bed form in FIG. 13, further operations of the button switch are canceled. In addition, the motor M is not driven while the safety switch S for detecting whether a hand is caught anywhere in the bed is pressed.

After this form change, the integral mat 322 laid on the movable auxiliary bed B2 provides a continuous surface having no gap in the folded section. The mat 322 on the backrest section is integrated with the user so that sliding caused by the difference between the mechanical folding fulcrum 310 of the backrest section 304 of the movable auxiliary bed B2 and the fulcrum around the waist of the patient used by said patient to stand up or lie down is allowed to escape between the mat 322 and the floor section of the movable auxiliary bed B2. In this case, the protrusion-restraining guide 304*a* guides the sliding of the mat 322 on the backrest section 304.

Of course, the multifunction bed according to the present invention can be composed of the movable auxiliary bed B2 alone. In this case, the drive device such as the motor M for changing the form is desirably provided on the movable auxiliary bed B2. Although in the above description, the movable auxiliary bed B2 is changed between the bed form, reclining seat form, and wheelchair form, it may be stopped between any two of these positions.

As described above, the present invention improves the feeling in bed of an elder person or other patient without hindering the form-change function of a multifunction bed, by allowing the person to stand up and lie without the need for special nursing. During the form change, the present invention can prevent such accidents as a patient's hand becoming caught in a gap in the floor section of the bed. Since the person lying on the bed well fits the mat laid on the floor, the person uses the bed comfortably. The protrusion-restraining guide of the mat prevents the mat from slipping off and falling from the backrest section of the floor section of the bed while allowing the mat to slide on the backrest section. By engagingly locking the mat on the bed at the footrest and in the neighborhood of the connection point between the backrest section and the seat section, a sliding effect can be obtained despite the simple mounting used.

What is claimed is:

1. A multifunction bed comprising a U-shaped fixed bed body and a wheelchair that is fitted in a cut-out section of the bed body to form part of a bed surface, the multifunction bed capable of having an inclination changed between a wheelchair state and a bed state in which a backrest surface section, a seat surface section, and a footrest surface section constituting the wheelchair have been generally changed to a horizontal position, characterized in that a switch is provided that detects whether any foreign matter is caught between said fixed bed body and said wheelchair in order to force change of an inclination to be stopped.

2. A multifunction bed as in claim 1, characterized in that said switch is provided on a side of the bed surface of said bed body as opposed to said backrest surface section of the wheelchair.

3. A multifunction bed as in claim 1 or claim 2, characterized in that said switch comprises a belt switch arranged to detect whether any foreign matter is caught between said fixed bed body and said wheelchair.

4. A multifunction bed having traveling wheels and arranged to be changed between a bed form forming a flat floor section and a wheelchair form forming a seat surface, characterized in that an integral mat having no seam from a leg section to a head section is laid on a top surface of the floor section of said bed, wherein a top surface of a backrest section of the floor section of said bed is sufficiently smooth such that the mat on a backrest section in the wheelchair form can be freely moved along the patient's body length, and a guide for restraining said mat from protruding from the bed is provided on the side of the backrest section of said floor section.

5. A multifunction bed as in claim 4, characterized in that a backrest section, a seat section, and a footrest are connected together to form the floor section of said bed, and the bed is configured so as to be changed between the bed form and the wheelchair form by folding a connection section between said sections, and in that said mat is mounted on the bed in the neighborhood of a connection point between the backrest section and the seat section and at the footrest.

6. A multifunction bed, comprising:

a fixed U-shaped bed having a U-shaped cut-out section therein;

a movable auxiliary bed being detachably fitted in said cut-out section of said fixed U-shaped bed, said movable auxiliary bed having underlying wheels for travel and a backrest section, a seat section and a leg-rest section connected with one another so that said movable auxiliary bed can be transformed from a horizontal bed form to a wheelchair form; and a switch means for gradually transforming said movable auxiliary bed from said horizontal bed form to said wheel chair form by touching of the switch means.

7. A multifunction bed, comprising:

a fixed U-shaped bed having a U-shaped cut-out section therein; and a movable auxiliary bed being detachably fitted in said cut-out section of said fixed U-shaped bed, said movable auxiliary bed having underlying wheels for travel and a backrest section, a seat section and a leg-rest section connected with one another so that said movable auxiliary bed can be transformed from a horizontal bed form to a wheelchair form, wherein in order to prevent the person lying on the bed from being pushed forward while the movable auxiliary bed is being changed to the wheelchair form, said seat section is inclined according to an inclination of said backrest section so that part of said seat section closer to said leg-rest section is located higher than an opposed part, thereby allowing buttocks of the person lying on the bed to sink relative to the horizontal bed form.

8. A multifunction bed, comprising:

a fixed U-shaped bed having a U-shaped cut-out section therein; and a movable auxiliary bed being detachably fitted in said cut-out section of said fixed U-shaped bed, said movable auxiliary bed having underlying wheels for travel and a backrest section, a seat section and a leg-rest section connected with one another so that said movable auxiliary bed can be transformed from a horizontal bed form to a wheelchair form, wherein said movable auxiliary bed can be changed to the wheelchair form within said fixed U-shaped bed using a power transmission section on said fixed U-shaped bed.

9. The multifunction bed as in claims 6, 7 or 8, characterized in that a self-lock means is used to change to the wheelchair form, and after the bed form has been changed to the wheelchair form and when a drive source is stopped, the self-lock means automatically maintains the form in a stable condition.

10. The multifunction bed as in claims 6, 7 or 8, characterized by comprising a link mechanism for individually interlocking and connecting said backrest, seat, and leg-rest sections to a body frame so that a single drive source can deform a horizontal bed section of the movable auxiliary bed into the backrest, seat, and leg-rest sections of the wheelchair through use of said link mechanism.

11. The multifunction bed as in claims 6, 7 or 8, characterized in that when said movable auxiliary bed is fitted in said fixed U-shaped bed in order to return to an original horizontal position of said movable auxiliary bed, a user sitting in the wheelchair automatically returns to a lying position.

12. The multifunction bed as in claims 6, 7 or 8, characterized in that in the bed form for the horizontal position, auxiliary wheels automatically extend via a link mechanism to stabilize the position.

13. The multifunction bed as in claims 6, 7 or 8, characterized in that in the bed form, an armrest is housed in the rear of the backrest section, whereas in the wheel chair form, the armrest extends forward.

14. The multifunction bed as in claims 6, 7 or 8, characterized in that an inlet guard of said fixed U-shaped bed is provided which is arranged to be opened, closed, and locked.

15. A multifunction bed, comprising:

a fixed U-shaped bed having a U-shaped cut-out section therein;

a movable auxiliary bed being detachably fitted in said cut-out section of said fixed U-shaped bed, said movable auxiliary bed having underlying wheels for travel and a backrest section, a seat section and a leg-rest section connected with one another so that said movable auxiliary bed can be transformed from a horizontal bed form to a wheelchair form;

a drive source, comprising a rotation drive motor, for transforming the forms of said movable auxiliary bed; and a self-lock means, comprising a worm gear mechanism having a worm and worm gear, automatically maintaining the wheelchair form in a stable condition after the bed form has been transformed to the wheel chair form, when said drive source is stopped.

16. A multifunction bed, comprising:

a fixed U-shaped bed having a U-shaped cut-out section therein;

a movable auxiliary bed being detachably fitted in said cut-out section of said fixed U-shaped bed, said movable auxiliary bed having underlying wheels for travel and a backrest section, a seat section and a leg-rest section connected with one another so that said movable auxiliary bed can be transformed from a horizontal bed form to a wheelchair form;

a drive source, comprising a drive motor, for transforming the forms of said movable auxiliary bed; and a self-lock means, comprising a power transmission mechanism including a one-way clutch, automatically maintaining the wheelchair form in a stable condition after the bed form has been transformed to the wheel chair form when said drive source is stopped.

17. A multifunction bed, comprising:

a fixed U-shaped bed having a U-shaped cut-out section therein;

a movable auxiliary bed being detachably fitted in said cut-out section of said fixed U-shaped bed, said movable auxiliary bed having underlying wheels for travel and a backrest section, a seat section and a leg-rest section connected with one another so that said movable auxiliary bed can be transformed from a horizontal bed form to a wheelchair form;

a drive source, comprising a rotation drive motor, for transforming the forms of said movable auxiliary bed; and a self-lock means, comprising a power transmission mechanism including a ratchet wheel mechanism, automatically maintaining the wheelchair form in a stable condition after the bed form has been transformed to the wheel chair form when said drive source is stopped.

18. A multifunction bed, comprising:

a fixed U-shaped bed having a U-shaped cut-out section therein;

a movable auxiliary bed being detachably fitted in said cut-out section of said fixed U-shaped bed, said movable auxiliary bed having underlying wheels for travel and a backrest section, a seat section and a leg-rest section connected with one another so that said movable auxiliary bed can be transformed from a horizontal bed form to a wheelchair form;

a drive source, comprising a rotation drive motor, for transforming the forms of said movable auxiliary bed; and a self-lock means, comprising a screw-type power transmission mechanism, automatically maintaining the wheelchair form in a stable condition after the bed form has been transformed to the wheel chair form when said drive source is stopped.

19. A multifunction bed, comprising:

a fixed U-shaped bed having a U-shaped cut-out section therein; and a movable auxiliary bed being detachably fitted in said cut-out section of said fixed U-shaped bed, said movable auxiliary bed having underlying wheels for travel and a backrest section, a seat section and a leg-rest section connected with one another so that said movable auxiliary bed can be transformed from a horizontal bed form to a wheelchair form, wherein when the movable auxiliary bed in the wheelchair form is moved in the U-shaped cut-out section of said fixed U-shaped bed, it is automatically joined and fixed to a power transmission section placed on said fixed U-shaped bed.

* * * * *